US005388618A

United States Patent [19]

Decock

[11] Patent Number: 5,388,618

[45] Date of Patent: Feb. 14, 1995

[54] WEAVING-MACHINE CONTROL WITH DISPLAY OF THE SITE AND NATURE OF THREAD BREAKS

[75] Inventor: Bernard Decock, Kortrijk, Belgium

[73] Assignee: Picanol N.V., Belgium

[21] Appl. No.: 133,346

[22] Filed: Oct. 8, 1993

[30] Foreign Application Priority Data

Oct. 14, 1992 [BE] Belgium ..... 9200891

[51] Int. Cl.[6] ..... D03J 1/00

[52] U.S. Cl. ..... 139/1 R; 139/353; 139/370.2; 364/470; 364/921.1

[58] Field of Search ..... 139/353, 1 R, 370.2, 139/450; 364/470, 921.1

[56] References Cited

U.S. PATENT DOCUMENTS 5,285,821 2/1994 Fredriksson ..... 139/1 R

FOREIGN PATENT DOCUMENTS 192278 12/1907 Germany .

3033250 2/1991 Japan ..... 139/1 R

OTHER PUBLICATIONS

M. Andre, "le Mini-Ordinateur Controle, Qualite et production en tissage," Jun. 1976, pp. 361-362, Paris.

*Primary Examiner*—Andrew M. Falik

*Attorney, Agent, or Firm*—Bacon & Thomas

[57] ABSTRACT

A control system for adjusting and/or checking the operational parameters of a weaving machine includes a control unit with a monitor, the control unit including an image memory for storing images of the site and/or type of thread breaks. The images are displayable on the monitor when a thread break occurs, and are associated by the control unit with selection keys which, when actuated, allow data concerning the site and/or the kind of thread break that occurred to be fed into the control unit.

9 Claims, 2 Drawing Sheets

WEAVING-MACHINE CONTROL WITH DISPLAY OF THE SITE AND NATURE OF THREAD BREAKS

BACKGROUND OF THE INVENTION

1. Field of the Invention

The invention concerns a control system for adjusting and/or checking the operational parameters of a weaving machine of the type which includes a control unit with a monitor.

2. Description of Related Art

As a rule, the control unit of a weaving machine includes an input device which allows an operator to select and adjust operational parameters. The set operational parameters can be displayed on a monitor during operation, and thus can be checked and, where called for, changed.

Conventionally, weaving-machine operators keep records of the occurrences as well as of the site and/or nature of thread breaks. These records make it possible for the operator to determine whether the weaving machine is set at advantageous operational parameters. If thread breaks occur too often, especially when they occur at the same site and are of the same kind, the operator can change operational parameters using the control unit.

A disadvantage of such a system is that the checking and adjustment depends to a large extent on the operator's qualifications. If the thread-break records are inaccurate or improperly assessed, the adjustment of one or more operational parameters may be carried out in the wrong direction.

SUMMARY OF THE INVENTION

It is an object of the invention is to improve a weaving-machine control system for adjusting and/or checking the operational parameters of a weaving machine by reducing dependence on the qualifications of the operator.

This problem is solved by including in the control unit a memory for images of the sites and/or type of kinds of thread breaks, the images being displayable on the monitor when a thread break occurs, and by including selection keys associated with the images so that data regarding the site and/or the type or kind of the thread break can be fed into the control unit.

The design of the invention substantially lowers the danger of an operator incorrectly assessing the site and/or the kind of a thread break and recording it improperly. The data concerning the site and/or the kind of thread break fed into the control unit can be retrieved at any time by the operator, simplifying for the operator the analysis of the thread breaks with respect to the set operational parameters.

In a preferred embodiment of the invention, the control unit includes an analyzer for evaluating the input data with respect to the site and/or kind of thread break in relation to the set operational parameters and, where called for, for emitting a signal to change one or more operational parameters. As a result, the operator is relieved of the task of analyzing the thread breaks in relation to the operational parameters, and analysis no longer depends on the skill of the operator. Signals emitted to change the settings of one or more operational parameters may either be displayed on the monitor for the operator's information, so that the operator may then implement the changes, or may be directly fed by the control unit to adjusting means for automatically setting the operational parameters.

In a further preferred embodiment of the invention, the control unit includes a restart interlock that can be disengaged by actuating a selection key, such that if the operator does not reliably feed the data concerning a thread break into the control unit, the weaving machine will not start again.

DETAILED DESCRIPTION OF THE PREFERRED EMBODIMENTS

Figure 1:
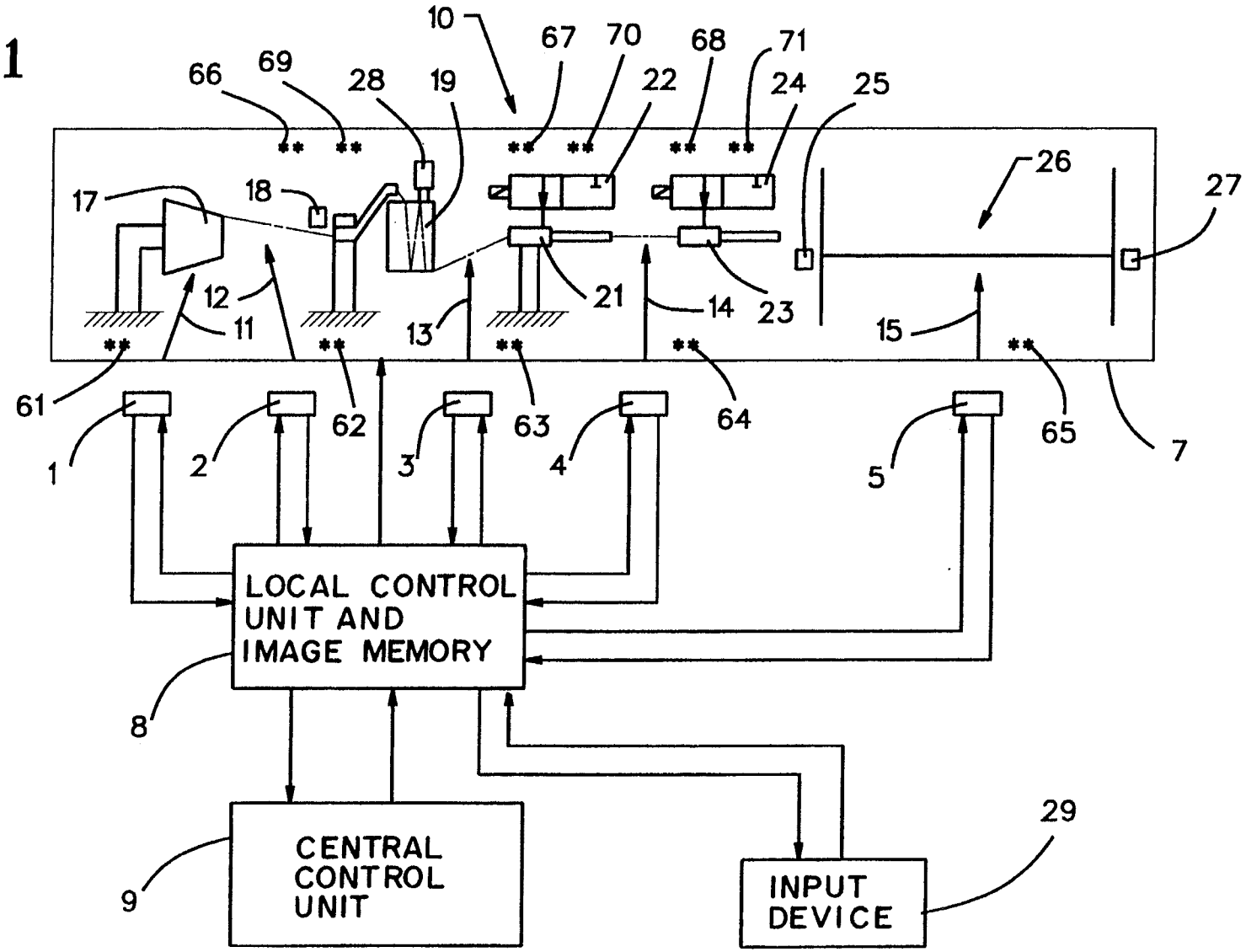
FIG. 1 is a schematic diagram of a control unit with a monitor showing the possible sites of weft yarn breaks according to a preferred embodiment of the invention.

The illustrative implementation of a control for an airjet weaving machine of FIG. 1 contains a local control unit 8 with a hooked-up monitor 7. An input device 29 is part of the control system. FIG. 1 further shows that the control units of individual weaving machines can be connected to a central control unit 9 belonging to several weaving machines. Selection keys 1, 2, 3, 4 and 5 are present below the monitor 7.

If a thread break occurs during weaving machine operation, it is detected by a thread sensor and information about the break is fed to a local control unit 8. Thereupon, the control unit 8 shuts down the weaving machine, where called for, as prescribed by a predetermined program.

Following the detection of the thread break, the control unit 8 also retrieves real images of pictures of possible sites and/or kinds of thread breaks from an image memory in control unit 8 and causes them to be displayed on the monitor 7. If, for instance, a thread sensor of the weft insertion system gives notice of a thread break, then an image 10 depicting possible thread break sites as shown in FIG. 1 is retrieved from memory 9 and displayed. In this image 10, all means for inserting wefts are schematically depicted simultaneously, namely a bobbin 17, a thread sensor 18, a prespooling device 19, a stationary accessory-main blow-in nozzle 21 with associated valve 22, a main blow-in nozzle 23 displaceably mounted to the batten and with associated valve 24, a thread sensor 25 at the beginning of a shed 26, and a thread sensor 27 at the end of the shed. A blocking pin 28 of the pre-spooling device 19 is also shown in the image 10.

Once the weaving machine is shut down, the operator ascertains the site of the thread break and thereupon depresses an associated selection key 1,2,3,4 or 5. These selection keys 1 through 5 are associated by the control unit with the possible thread-break sites shown in the image 10. In the embodiment shown, arrows 11, 12, 13, 14, 15 in image 10 lead from the selection keys 1 through 5 to the corresponding sites. When one of the selection keys 1 through 5, selected by comparing the ascertained site with the image 10, is actuated, the data concerning the weft break site are fed to the control unit 8.

In a particularly advantageous embodiment of the invention, the control unit provides the operator with information about the likely site of a weftbreak. In this embodiment, depending for example on whether the thread break has taken place near the thread sensor 18, 25 or 27, and on the control unit 8 having received a corresponding signal, the control unit will analyze the signal in order to specify one or more of the selection keys 1 through 5. The control unit 8 then specifies the selection keys 1, 2 or 5 corresponding to sensors by lighting a lamp associated with them. If the lamps associated with the selection keys 1 and 2 light up, the operator will know that the weft on the bobbin 17 or between the bobbin and the pre-spooling device 19 has broken. If the lamp associated with the selection key 5 lights up, the operator is notified that the weft likely broke in the shed 26. If none of the lamps lights up, the operator knows that the weft probably broke in the region between the pre-spooling device 19 and the accessory-main blow nozzle 21, or in the region between the accessory-main blow nozzle and the main blow nozzle 23.

If the weft broke in the vicinity of the shed 26, both the type of thread break and its site are fed into the control unit. For that purpose, the actuation of the selection key 5 retrieves another image 20, shown in FIG. 2, from the storage of the control unit 8 and causes it to be displayed on the monitor 7. This image 20 includes several sub-images 31, 32, 33, 34 and 35, each associated as indicated by the arrows 11, 12, 13, 14, 15 with one of the selection keys 1 through 5. Sub-image 31 shows a loop in the weft, sub-image 32 depicts a weft which is too short, sub-image 33 shows a common weft, image 34 shows a weft with two parts, and sub-image 35 depicts a weft break of an arbitrary other kind. A further image with additional kinds of weft breaks may be retrieved and displayed when depressing the selection key 5 associated with the arbitrary sub-image 35 of FIG. 2, the selection keys 1 through 5 then being associated with different kinds of weft breaks. As a result, the operator very easily can carry out a further selection from among possible types of weft breaks.

Figure 2:
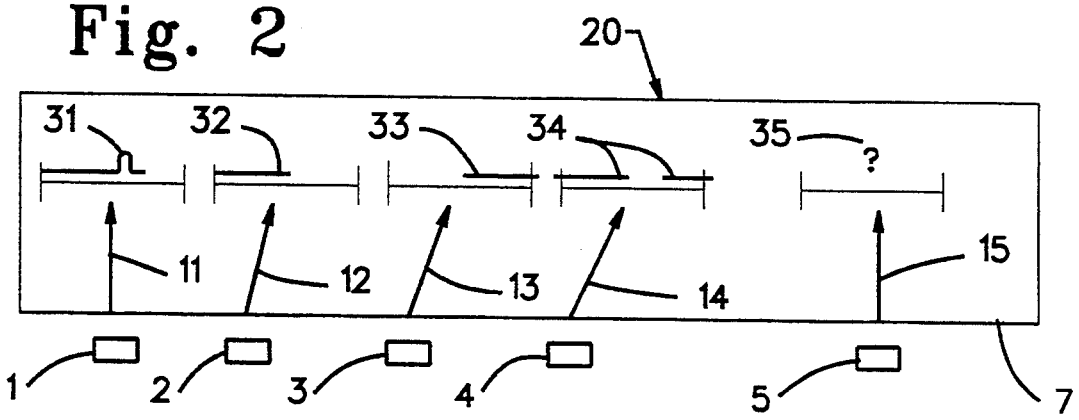
FIG. 2 illustrates an image of different types of weft yarn breaks in the shed zone as displayed on the monitor of FIG. 1.

The operator is also able to select from inside the sub-images 31, 32, 33 and 34 and to accurately associate the actual weft break to a picture of one. For example, if the selection key 4 associated with the sub-image 34 of FIG. 2 is depressed, then another image 30 is retrieved and displayed on the monitor 7. This image 30 contains three sub-images which more closely specify the sub-image 34 of the image 20. The sub-image 36 shows a weft break at the beginning of the shed, the sub-image 38 shows a weft break at the center of the shed, and the sub-image 38 shows a weft break at the end of the shed. Only three selection keys 1, 3 and 5 are associated through arrows 11, 13, 15 with these three sub-images 36, 37, 38. As a result, it is possible to very accurately feed the data concerning the weft break that occurred to the control unit 8.

Figure 4:
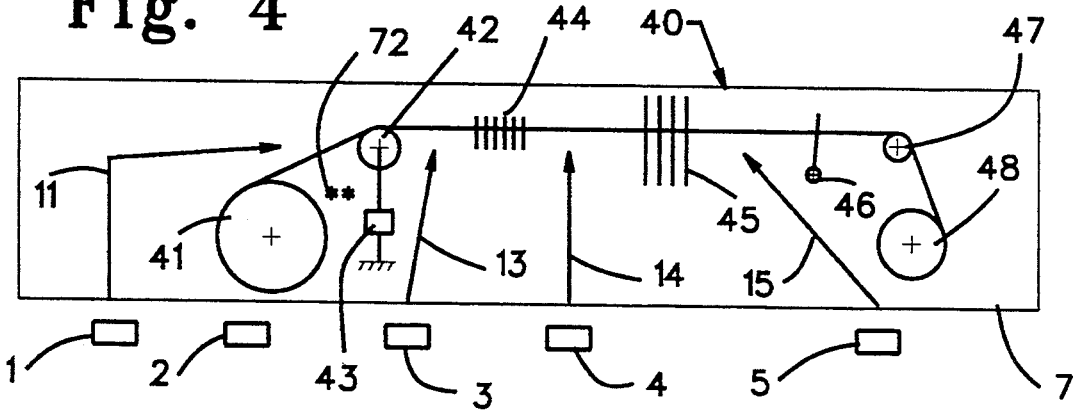
FIG. 4 illustrates a display by the monitor of FIG. 1 of possible sites of warp yarn breaks.

If the thread break took place in the area of the warps, then such a break is also signaled to the control unit 8. Thereupon, the control unit 8 retrieves an image 40 from storage and moves it to the monitor 7 for reproduction showing the possible sites of warp breaks and associating them with the selection keys 1 through 5. The image 40 shown in FIG. 4 schematically depicts a warp beam 41, a whip roll 42, a warp tension meter 43, a warp stop-motion 44, harnesses 45, a reed 46, a breast beam 47 and a cloth beam 48. In the image, the selection keys 1,3,4,5 are associated with the possible warp-break sites. Once the operator has ascertained the actual site of the warp break, he or she will then actuate the corresponding selection key 1, 3, 4 or 5 to enter the data concerning the site of the warp break.

Figure 5:
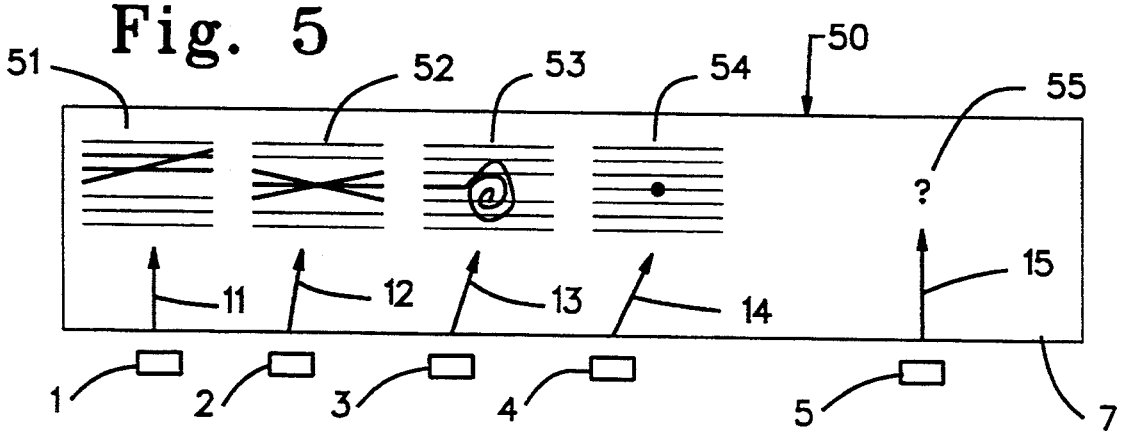
FIG. 5 illustrates a display by the monitor of FIG. 1 of different types of warp yarn breaks.

Particularly in the zone of the warp stop-motion 44, and between the warp stop-motion and the harnesses 45, it is also advantageous to enter data concerning the type of warp break to the control unit. For that purpose, when the selection key 3 or 4 is actuated, a further image 50, as shown in FIG. 5, is retrieved and displayed on the monitor 7, image 50 representing types of warp breaks in several subimages. Sub-image 51 shows crossed warps, sub-image 52 shows a loop in the warps, sub-image 53 depicts a tangled warp, sub-image 54 shows an inadmissible thickness in a warp, and sub-image 55 depicts an arbitrary kind of warp break different from those shown in the previous sub-images. If the selection key 5 is actuated, further images can be retrieved and displayed on the monitor, showing further kinds of warp breaks in sub-images and thereby allowing close association of the actual warp break with the further information to be fed to the control unit.

The data concerning the site and/or kind of thread breaks to be fed to the local control unit 8 of the weaving machine may be processed in control unit 8 or in a central control unit 9. Illustratively, the number of actuations of the individual selection keys 1 through 5 are counted, and conclusions concerning the particular site and kind are drawn from the association with one of the images 10, 20, 30, 40, 50. For example, the result of the processing may be used for statistical purposes or as information allowing the operator to optimize the control or adjustment of weaving-machine components.

In an especially advantageous design, the control unit 8 or 9 includes an analyzer for not only recording and counting the data regarding site and kind of thread breaks that did occur, but which is furthermore configured to analyze the data together with the set operational parameters and, if too many thread breaks occur at an ascertained site and of an ascertained kind, cause a change in one or more of the operational parameters. In one embodiment involving the analyzer, the control unit 8 automatically adjusts toward optimization, i.e., to reduce the thread breaks. If, for example, the analyzer ascertains that too many loops have arisen in the weft (subimage 31 of FIG. 2), the data having been fed through the selection key 1 a corresponding number of times to the control unit, then the analyzer will determine that the main blow nozzle 23 has expelled compressed air for too long a time and the control unit 8 will independently cause the valve 24 of the main blow nozzle 23 to close earlier to avoid loops in the wefts. Alternatively, the control unit 8 or 9 may cause a display to appear on the monitor 7 which indicates to the operator that the valve 24 of the main blow nozzle 23 should close earlier. Thereupon, the operator may carry out this adjustment through the input device 29 of the control unit.

Similarly, the analyzer may directly carry out or instruct the operator to carry out other changes in the settings of the operational parameters, for example, the control times of the blocking pins 28, the control times of the valve 22 of the accessory-main blow nozzle 21, or the pressure of the compressed-air supply for the accessory-main blow nozzle 21 and/or the main nozzle 23. As in the example of compressed air time, the analyzer also may be used to reduce the number of warp breaks by either causing the automatic reduction of the warp tension or by instructing the operator to do so.

The analyzer may also be part of the central control unit 9. When the central control unit 9 receives data concerning the site and/or kinds of thread breaks from the control unit 8, the central control unit 9 transmits to the control unit 8 of the individual weaving machines the corresponding commands in order to implement changes in the operational-parameter settings on its own or through the intervention of the weaver.

Figure 3:
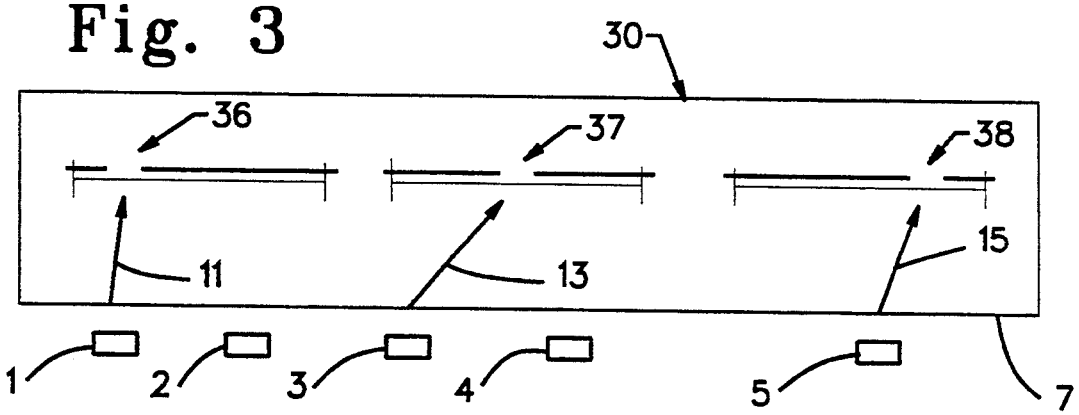
FIG. 3 illustrates a further display by the monitor of FIG. 1 of weft yarn breaks by type in the shed zone.

In another embodiment of the invention, the control unit 8 includes a restart interlock which prevents the weaving machine from being restarted when the site and kind of a thread break fails to be fed to the control unit 8. For that purpose, provision may be made so that the restart interlock can only be disengaged by actuating a selection key 1 through 5. Provision may also be made so that one of the then inoperative selection keys, for instance the selection keys 2 and 4 of image 30 of FIG. 3, does not disengage the restart interlock. Moreover, provision may be made to allow an actual thread break to be fed only once to the control unit, i.e., by allowing actuation of one of the selection keys 1 through 5 a single time after a thread break has occurred.

The invention offers the advantage of requiring no complex or expensive sensors to detect and record various sites and/or kinds of thread breaks. Furthermore, when implementing the control unit, it is possible to display further information important to the operator on the monitor in the form of images 10, 20, 30, 40, 50, by allowing the operator to issue a command through the input device 29 to display additional values in the images. Illustratively, displays 61, 62, 63, 64, 65 may be associated with the selection keys 1,2,3,4,5 in image 10 of FIG. 1, the displays 61–65 showing the number of actuations of the particular selection keys 1 through 5, since, for example, the last setting-change of the :weaving machine. In addition, further information may be displayed simultaneously with the pictures on the monitor 7, such as the open time 66 and the closed time 69 of the blocking pin 28 of the pre-spooling device, the open time 67 and the closed time 70 of the valve 22, and the open time 68 and the closed time 71 of the valve 24. Complementary representations are possible in other pictures. For instance, the warp tension can be shown by a display 72 in image 40, as illustrated in FIG. 4.

Those skilled in the art will appreciate that there is no need per se to associate the selection keys 1 through 5 by means of arrows 11–15 to the particular sites and/or kinds of thread breaks in the images 10, 20, 30, 40, 50. For example, the selection keys 1 through 5 may be denoted by characters or letters and the corresponding characters or letters may be associated with the sites and/or kinds of thread breaks. In that case, the selection keys may also be components of the input device 29.

Having thus described in detail preferred embodiments of the invention which will be easily implemented by those skilled in the art, it will nevertheless also be appreciated that design changes from the illustrated embodiments are possible. For example, following machine shutdown, the operator may first ascertain the site and/or kind of thread break and then retrieve possible images of the site and/or kind of thread break via the input 29 of the control unit. A confirmation key may be provided which, when the image is found, may be actuated to cause the corresponding data to be fed to the control unit.

In view of the potential for variations and modifications, it is intended that the invention not be limited by the above description and accompanying illustrations, but rather that it be limited solely by the appended claims.

I claim:

1. In a control system for a weaving machine which includes a control unit with a monitor, the improvement wherein the control unit comprises memory means for storing real images or pictures of possible sites, types, or sites and types, of thread breaks, and means for displaying the images on the monitor upon the occurrence of a thread break, the control system further comprising means including a plurality of selection keys for allowing entry into the control unit of data concerning a thread break that has occurred.

2. A control system as claimed in claim 1, wherein the control unit includes means actuated by a signal from a thread sensor to retrieve one of said images which depicts possible thread break sites from said memory means and display it on the monitor, and means for associating the selection keys with individual sites depicted in the displayed image.

3. A control system as claimed in claim 1, wherein the control unit comprises means for preventing a restart of the weaving machine unless one of the selection keys is actuated.

4. A control system as claimed in claim 2, wherein one of the images contains sub-images of means for inserting weft threads, and further comprising means for associating said weft thread insertion means with selection keys to indicate an area of possible weft break sites.

5. A control system as claimed in claim 2, wherein one of the images depicts several types of weft breaks, and further comprising means for associating each of the types of weft break with one of the selection keys.

6. A control system as claimed in claim 2, wherein one of the images shows means for guiding, transporting and monitoring warp threads, and further comprising means for associating the selection keys with the guiding, transporting, and monitoring means in the area of possible sites of warp breaks.

7. A control system as claimed in claim 2, wherein one of the images represents several types of warp breaks, and further comprising means for associating each of the types of warp breaks with one of the selection keys.

8. A control system as claimed in claim 1, wherein the control unit contains analyzer means for evaluating input data concerning a site, type, or site and type of thread break in relation to set operational parameters of the weaving machine and, where called for, emitting a signal to automatically change a setting of at least one of the operational parameters.

9. A control system as claimed in claim 1, wherein the control unit contains analyzer means for evaluating input data concerning a site, type, or site and type of thread break in relation to set operational parameters of the weaving machine and, where called for, displaying on the monitor an instruction to an operator concerning the operational parameters to be adjusted.

* * * * *